US006077649A

United States Patent [19]

Torisawa

[11] Patent Number: 6,077,649

[45] Date of Patent: Jun. 20, 2000

[54] HEAT DEVELOPING METHOD AND APPARATUS FOR HEAT DEVELOPMENT

[75] Inventor: Nobuyuki Torisawa, Kanagawa, Japan

[73] Assignee: Fuji Photo Film Co., Ltd., Kanagawa, Japan

[21] Appl. No.: 09/137,832

[22] Filed: Aug. 21, 1998

[30] Foreign Application Priority Data

Aug. 26, 1997 [JP] Japan ..... 9-229642

[51] Int. Cl.[7] ..... G03C 5/29; G03C 8/40; G03D 5/00; G03D 15/00

[52] U.S. Cl. ..... 430/353; 430/203; 430/330; 430/403; 396/575

[58] Field of Search ..... 430/203, 353, 430/403, 330; 396/575

[56] References Cited

U.S. PATENT DOCUMENTS

| | | | |
|---|---|---|---|
| 4,052,732 | 10/1977 | Meadows | 396/575 |
| 5,122,433 | 6/1992 | Kawaguchi | 430/203 |
| 5,502,532 | 3/1996 | Biesinger et al. | 396/575 |
| 5,800,968 | 9/1998 | Furukawa | 430/203 |
| 5,834,155 | 11/1998 | Uehara | 430/203 |
| 5,907,735 | 5/1999 | Ogiwara | 396/575 |

*Primary Examiner*—Richard L. Schilling
*Attorney, Agent, or Firm*—Sughrue, Mion, Zinn, Macpeak & Seas, PLLC

[57] ABSTRACT

A heat developing method for obtaining a visible image comprising contacting a heat-developable light-sensitive material or a light-sensitive heat-sensitive recording material on which a latent image has been formed with a heating means in a heat developing part, wherein the heat-developable light-sensitive material or light-sensitive heat-sensitive recording material which is peeled off from the heating means is cooled, in a noncontacting state, to a temperature not higher than a temperature at which progress of development is stopped, and then the material is held with a transfer means for discharging the material outside of the heat developing part, and a developing apparatus for obtaining a visible image.

1 Claim, 3 Drawing Sheets

HEAT DEVELOPING METHOD AND APPARATUS FOR HEAT DEVELOPMENT

FIELD OF THE INVENTION

The present invention relates to a heat developing method and a heat developing apparatus, and more particularly it relates to a heat developing method and a heat developing apparatus applied to recording in a dry system such as image recording using a dry material to which no wet processing is conducted.

BACKGROUND OF THE INVENTION

In an image recording apparatus for recording a medical image using a heat storage fluorescent sheet, e.g., a digital radiographic system, CT, MR, etc., a wet system in which an image is photographed or recorded on a silver salt photographic light-sensitive material, and then wet processed to obtain a reproduced image, has been used.

However, in recent years, a recording apparatus by a dry system in which wet processing is not necessary to be carried out has attracted public attention. In such a recording apparatus, a light-sensitive and/or a heat-sensitive recording material (a light-sensitive heat-sensitive recording material) and a heat-developable light-sensitive film (hereinafter referred to as "a recording material") are used. In this recording apparatus by a dry system, a latent image is formed by irradiation of a laser beam (scanning) on a recording material at exposing part, then the recording material is heat developed by contacting with a heating means such as a heating drum at heat developing part, thereafter the recording material on which an image has been formed is discharged from the recording apparatus.

By such a dry system, not only image formation can be effected within a short period of time as compared with wet processing but also a problem of the disposal of a waste water in wet processing can be resolved, therefore, the increase of demand for such a system in the future is predictable enough.

In the above-mentioned dry system, high image quality is required particularly for medical images, so that recording materials higher in sensitivity are used. Accordingly, slight fluctuations in developing temperature causes great deterioration of image quality.

Now, development is usually performed at a high temperature of about 120° C., so that heat given in the development remains in the recording materials even after peeled off from the heating means. Further, it is known that development proceeds even at a temperature of about 90° C., although it depends on the kind of recording material. The recording materials immediately after peeled off from the heating means have a temperature within this development proceeding temperature range.

On the other hand, in heat developing apparatuses of this kind, peeling claws for securely peeling off the recording materials from the heating means are usually provided in close proximity to the heating means. When the recording materials still having a temperature within the development proceeding temperature range immediately after peeling off from the heating means come into contact with the peeling claws, differences in heat conduction between contact portions and other portions are developed, resulting in appearance of image defects on the contact portions.

SUMMARY OF THE INVENTION

The present invention was made in view of the above-mentioned problem.

An object of the present invention is to provide a heat developing method and a heat developing apparatus which prevent occurrence of uneven development caused by contact of the recording materials having a temperature within the development proceeding temperature range with the other members to obtain images having uniform image quality.

The above-mentioned object is attained by (1) a heat developing method for obtaining a visible image comprising contacting a heat-developable light-sensitive material or a light-sensitive heat-sensitive recording material on which a latent image has been formed with a heating means in a heat developing part, wherein the heat-developable light-sensitive material or light-sensitive heat-sensitive recording material which is peeled off from the heating means is cooled, in a noncontacting state, to a temperature not higher than a temperature at which progress of development is stopped, and then, the material is held with a transfer means for discharging the material outside of the heat developing part; and (2) a heat developing apparatus for obtaining a visible image comprising a heat-developable light-sensitive material or a light-sensitive heat-sensitive recording material on which a latent image has been formed with a heating means in a heat developing part, wherein a transfer means for discharging the heat-developable light-sensitive material or light-sensitive heat-sensitive recording material which has been held outside of the heat developing part after completion of heat development, is separated from a portion in which the material is peeled off from the heating means, at an interval corresponding to a time for which the material is cooled to a temperature not higher than a temperature at which progress of development is stopped.

According to the above-mentioned heat developing method and apparatus, the heat-developable light-sensitive material or light-sensitive heat-sensitive recording material peeled from the heating means does not come into contact with other members until the temperature thereof is lowered to a development proceeding temperature or less. Accordingly, uneven development caused by contact does not occur, and uniform images having no defects are obtained.

DETAILED DESCRIPTION OF THE INVENTION

A heat developing method and apparatus according to the present invention are described in detail below based on the embodiments shown in the accompanying drawings.

Figure 1:
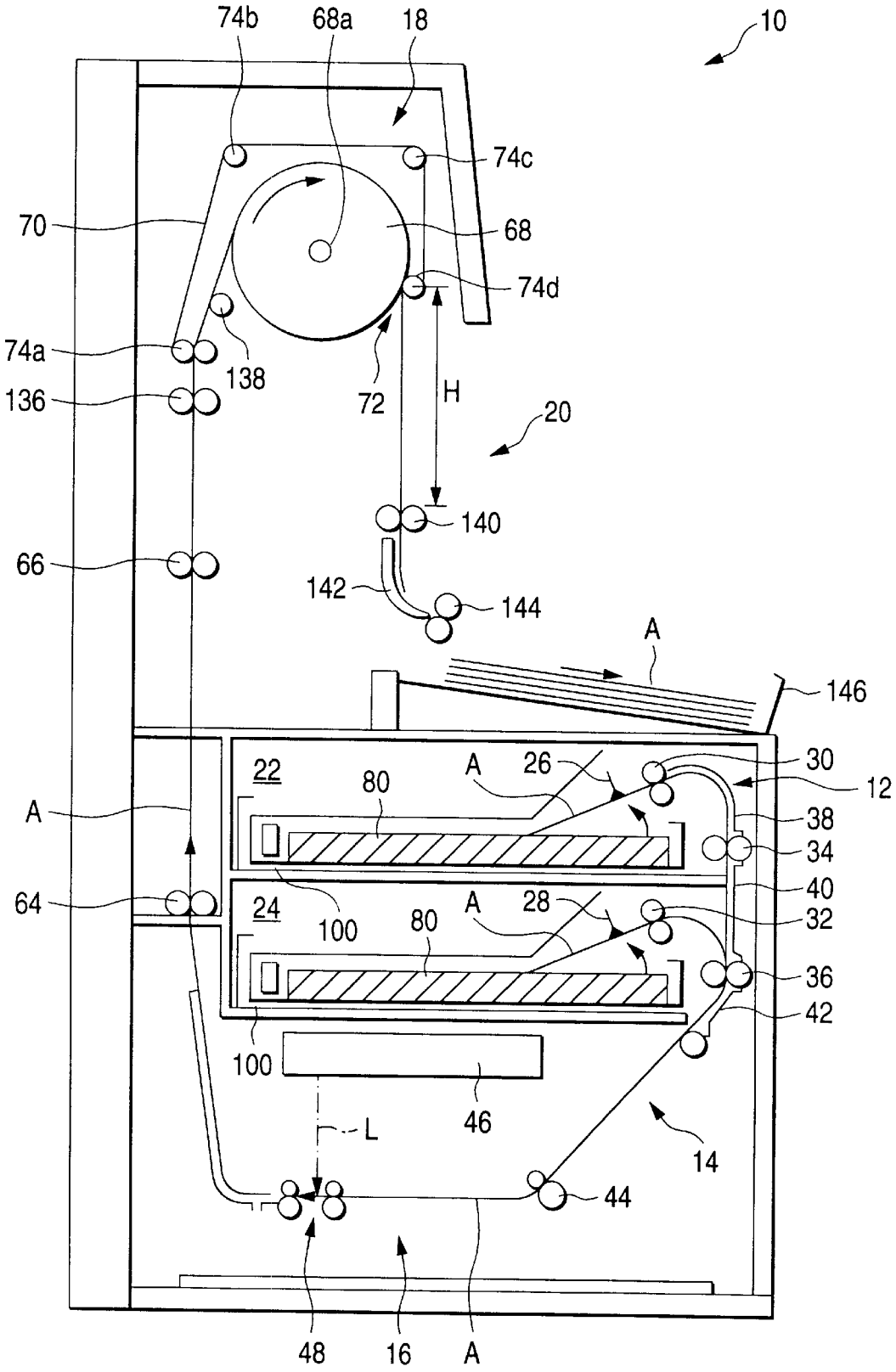
FIG. 1 is a schematic drawing showing a heat developing apparatus for conducting a heat developing method of the present invention.

FIG. 1 is a schematic view showing a heat developing apparatus according to the present invention. As shown in FIG. 1, heat developing apparatus 10 is constituted of, in order of transferring route of a heat-developable light-sensitive material or a light-sensitive heat-sensitive recording material (hereinafter referred to as "recording material A"), recording material feeding part 12, material-position adjustment part 14, image-exposing part 16, heat developing part 18 and discharge part 20 as main constituents.

Recording material feeding part 12 is a part for taking out and feed recording materials A one by one to material-position adjustment part 14 positioned downstream of transferring direction of recording materials A, which is constituted of loading parts 22 and 24, recording material feeding means having suction cups 26 and 28 arranged at each of the above loading parts, feeding roller pairs 30 and 32, transferring roller pairs 34 and 36, and transferring guides 38, 40 and 42.

Loading parts 22 and 24 are parts loaded with magazine 100 containing recording materials A at a determined position. In FIG. 1, there are two loading parts 22 and 24 and each loading part is generally loaded with magazine 100 containing recording materials A having different sizes respectively [e.g., half-cut size (i.e., 356×432 mm) for CT and MRI, B4 size (i.e., 257×364 mm) for FCR (Fuji computed radiography].

Recording material feeding means arranged at each of loading parts 22 and 24 transfers recording materials A to feeding roller pairs 30 and 32 arranged at each of loading parts 22 and 24 by adsorbing and holding recording materials A by suckers 26 and 28 and moving suckers 26 and 28 by well-known moving means such as link-mechanism, etc.

Examples of recording materials A include a heat-developable recording material and a light-sensitive heat-sensitive recording material.

A heat-developable recording material is a recording material on which an image is recorded (exposed) with at least one optical beam, e.g., a laser beam, followed by heat development to develop (form) colors.

Further, a light-sensitive heat-sensitive recording material is a recording material on which an image is recorded (exposed) with at least one optical beam, e.g., a laser beam, followed by heat development to develop colors, or an image is recorded by heat mode (heat) of a laser beam or a thermal head and colors are developed at the same time, and then fixation is effected by light irradiation.

Recording material A is processed to sheets and, in general, made into bundles of a prescribed unit, e.g., 100 sheets, etc., and packaged in a bag or a belt as package 80.

Recording material A at loading part 22 fed to feeding roller pair 30 is transferred through transferring roller pairs 34 and 36 being guided by transferring guides 38, 40 and 42, while recording material A at loading part 24 fed to feeding roller pair 32 is transferred through transferring roller pair 36 being guided by transferring guides 40 and 42, respectively, to material-position adjustment part 14 of downstream.

Material-position adjustment part 14 is a part where the position of recording material A is adjusted to the orthogonal direction against the transferring direction (hereinafter referred to as "width direction"), thereby the position of recording material A in the main scanning direction in image exposing part 16 of downstream is adjusted to take so-called side resist, and the material is transferred to image-exposing part 16 of downstream through transferring roller pair 44.

Methods of taking side resist in material-position adjustment part 14 are not particularly restricted. For example, there are exemplified various well-known methods, such as a method of using a resist plate which adjusts the position of recording material A in contact with one edge face of the width direction of the material and a pushing/moving means, e.g., a roller, which pushes and moves recording material A in the width direction to make an edge face of the material contact with a resist plate; a method of using the above resist plate and a guide plate which is movable in accordance with the size of recording material A in the width direction, which also makes the material contact with the resist plate by regulating the transferring direction of recording material A by the width direction, etc.

Recording material A transferred to material-position adjustment part 14 is transferred to image exposing part 16 of downstream by transferring roller pair 44 after undergoing position adjustment in the orthogonal direction against the transferring direction as described above.

Image exposing part 16 is a part where recording material A is imagewise exposed by optical beam scanning exposure, which is constituted of exposing unit 46 and sub-scanning transferring means 48.

Figure 2:
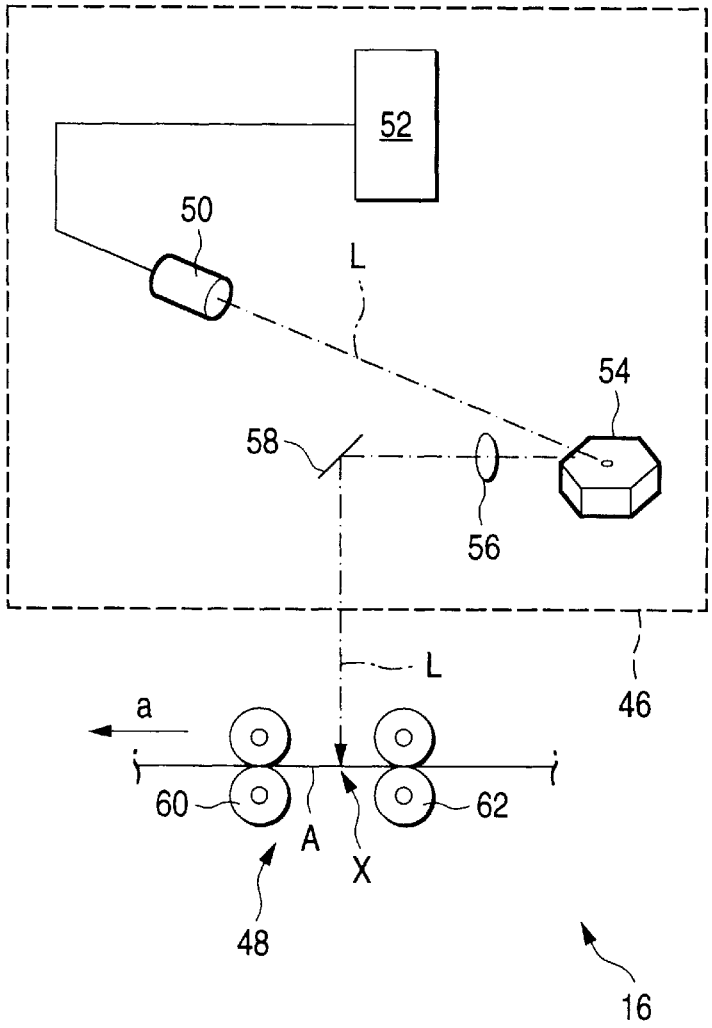
FIG. 2 is a schematic drawing showing an image exposing part in the heat developing apparatus shown in FIG. 1.
Figure 3:
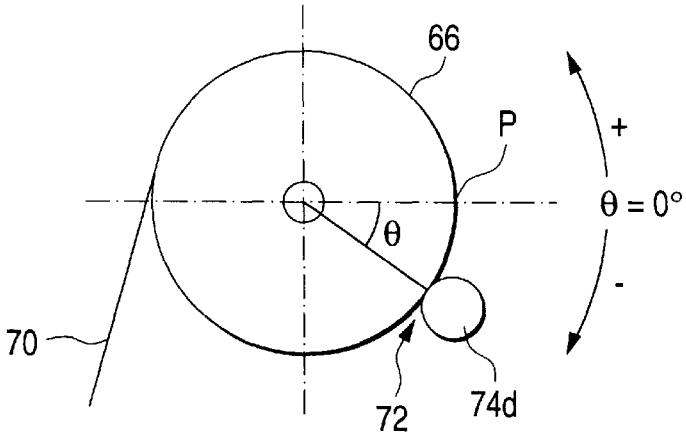
FIG. 3 is a schematic drawing showing a main part of a heat developing part in the heat developing apparatus shown in FIG. 1.

As shown in FIG. 2, exposure unit 46 is a well-known optical beam scanning apparatus, wherein optical beam L modulated according to the image to be recorded is deflected in the main scanning direction (the width direction of recording material A) to be subjected to incidence at predetermined recording position X Exposing unit 46 is constituted of light source 50 emitting optical beam L in narrow wavelength region according to spectral sensitivity characteristics of recording material A, recording controlling apparatus 52 which drives light source 50, polygonal mirror 54 which is a light-deflector, fθ lens 56, and down mirror 58.

In addition to the above, various members which are arranged in well-known optical beam scanning apparatuses are provided in exposing unit 46, such as a collimator lens and a beam expander which adjust optical beam L emitted from the light source, a face fall compensation optical system, a mirror for optical path adjustment, etc., according to necessity.

Record-controlling apparatus 52 drives light source 50 with modulating pulse width according to the image to be recorded and emits pulse width-modulated optical beam L according to the image to be recorded.

Optical beam L emitted from light source 50 is deflected by polygonal mirror 54 in the main scanning direction, modulated by fΘ lens 56 so as to form the image at recording position X, and the optical path is changed by down mirror 58 and subjected to incidence at recording position X.

FIG. 2 is the example for monochromatic image recording and exposing unit 46 comprises one light source 50 but when the exposing unit is used for color image recording, an exposing unit having three light sources emitting optical beams of wavelengths corresponding to spectral sensitivity characteristics of R (red), G (green) and B (blue) of the color light-sensitive material is used.

On the other hand, sub-scanning transferring means 48 has a pair of transferring roller pairs 60 and 62 arranged with recording position X (scanning line) between, and transfers recording material A in the sub-scanning direction orthogonal against the above-described main scanning direction (in the direction of arrow a in FIG. 2) with retaining recording material A at recording position x.

Here, as described above, since pulse width-modulated optical beam L according to the image to be recorded has been deflected in the main scanning direction, recording material A is two dimensionally scanning exposed by optical beam and a latent image is recorded.

The example in FIG. 2 is the constitution of directly modulating light source 50 to modulate the pulse width, but the present invention is also applicable to an apparatus of modulating pulse number, or an apparatus of indirect modulation using an external modulator such as AOM (acoustic modulator).

Image recording by analog intensity modulation is also effective.

As shown in FIG. 1, recording material A transferred to image exposing part 16 is exposed by optical beam scanning, e.g., a laser beam, and after a latent image is formed on recording material A, transferred to heat developing part 18 by transferring rollers 64 and 66. At that time, dusts on the front and back surfaces of recording material A are removed by dust-removing roller 136. Heat developing part 18 is a part for conducting heat development to convert the latent image to a visible image by heating the recording material A, and basically comprises heating drum 68 and endless belt 70.

Heating drum 68 is a drum having a light source for heating such as a halogen lamp and a heat source such as a heater, and the surface thereof is heated and held at a temperature depending on the heat developing temperature of recording material A. Further, the drum is driven for rotation around a shaft 68*a*, and transfers the recording material A by pinching it together with endless belt 70. In that case, recording material A is heat developed by contact with heating drum 68.

Endless belt 70 is formed of a heat-resistant material such as a metal (e.g., iron, copper or stainless steel), a polycarbonate film, an ethylene fluoride resin film, silicone rubber or a composite fluoride resin film, tightened around 4 rollers 74*a*, 74*b*, 74*c* and 74*d*, and pressed toward heating drum 68 so as to be wound around it.

Further, in endless belt 70, a surface thereof on a side at which the recording material is pressed is purified with a dust removing roller 138 disposed upstream from heating drum 68.

The present invention is characterized by the following constitution in heat developing part 18.

That is, distance H between portion 72 at which recording material A is peeled off from heating drum 68 and transferring roller pairs 140 for holding recording material A peeled and transferring it to a discharge path side (tray 146 side) is established so as to become longer than a distance requiring for natural cooling of recording material A peeled off from heating drum 68 to a temperature not higher than a temperature at which progress of development is stopped.

The above-mentioned "temperature at which progress of development is stopped" as used herein varies depending on the kind of recording material A. For example, when a heat-developable light-sensitive material described later is used as a first recording material, it is about 90° C., and when light-sensitive heat-sensitive recording materials described later are used as second and third recording materials, it is about 80° C.

The distance H described above is established so as to become a temperature equal to or lower than the development stopping temperature. However, the size of recording material A is usually standardized, so that the maximum value of distance H is substantially the length (entire length) of recording material A in its transfer direction. If distance H is longer than this length, recording material A is dropped off after a rear end of recording material A is peeled off from heating drum 68, possibly resulting in the failure to guide a leading edge (i.e., tip) thereof to transferring roller pairs 140, or the peeling of the rear end of recording material A from heating drum 68 without sufficient contact with heating drum 68 to cause uneven development. Accordingly, for cooling recording material A to a temperature equal to or lower than the development stopping temperature, a method is actual in which the distance H between peeling portion 72 and transferring roller pairs 140 is established, taking the entire length of recording material A as the maximum value, and the transferring speed is adjusted, depending on the kind of recording material A, namely the development stopping temperature thereof. For example, when recording material A of the half-cut size (i.e., 356×432 mm) is used and distance H is set to 430 mm, adjusting the distance to the entire length thereof, the transferring speed is adjusted to about 6 cm/second for the first recording material, and to about 5 cm/second for the second and third recording material, thereby reducing the temperature of recording material A at transferring roller pairs 140 to a temperature equal to or lower than each development stopping temperature.

There is no member in contact with recording material A, for example, no conventional peeling claw, at all between the above-mentioned separation portion 72 and transfer roller pairs 140. It is therefore preferred for ensuring the peeling of recording material A that peeling portion 72 is formed as follows.

In the peeling of recording material A from heating drum 68, the leading edge (i.e., tip) of recording material A is naturally peeled off from heating drum 68 by its own weight, and then descends with the rotation of the heating drum and the running of endless belt 70. Then, for performing the natural peeling of recording material A surely and smoothly, it is preferred that roller 74*d* is arranged within the range of ±45° upwards or downwards from position P to which a shaft center of shaft 68*a* of heating drum 68 is horizontally extended, taking it as $\theta=0$.

By the above-mentioned constitution, recording material A heat-developed and discharged from heating drum 68 is naturally cooled to a temperature equal to or lower than the development temperature while being withdrawn with the transferring rollers 140.

Figure 4:
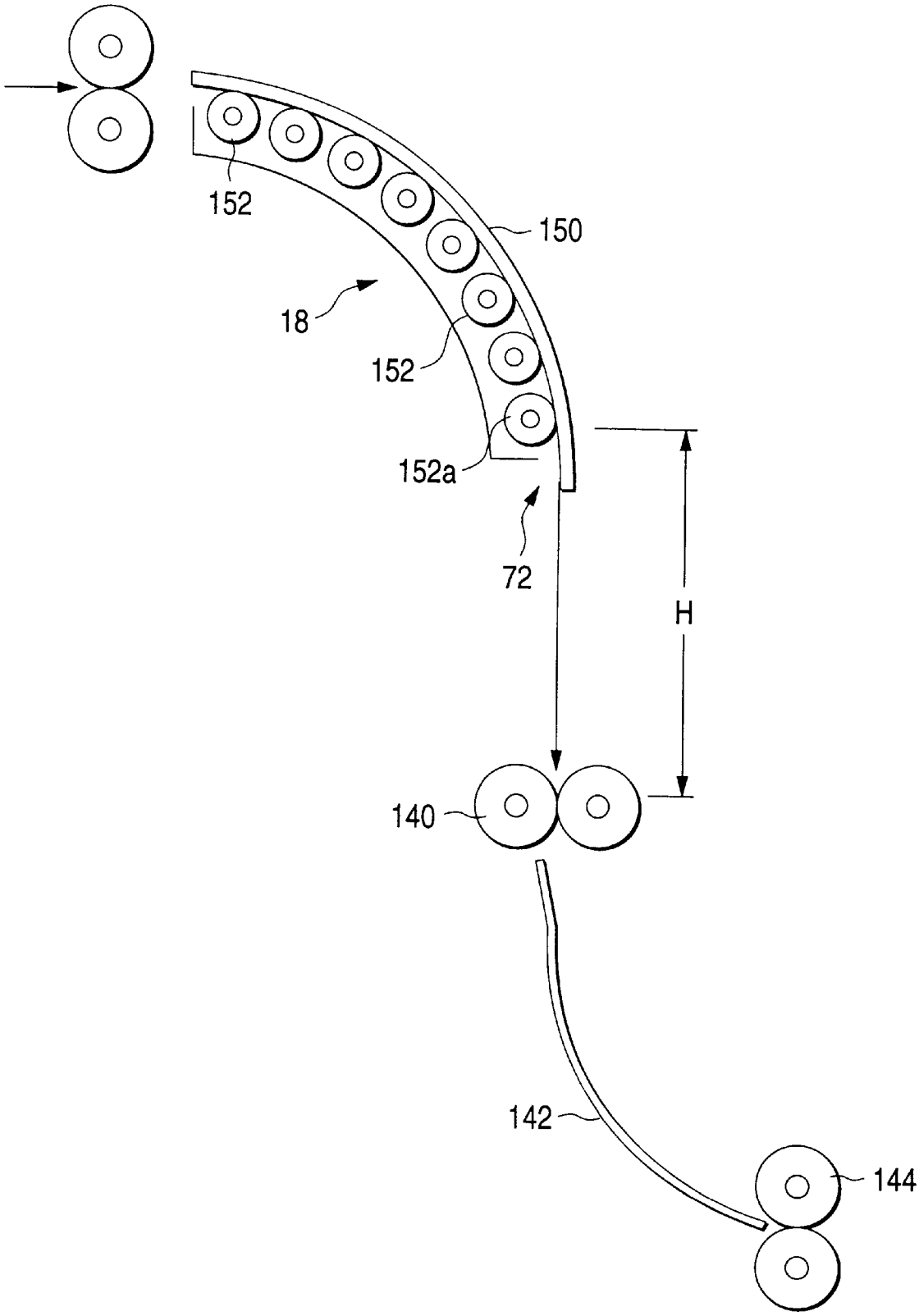
FIG. 4 is a schematic drawing showing another embodiment of the heat developing part in the heat developing apparatus of the present invention.

Heat developing part 18 may be made up of heat plate 150 curvedly disposed so as to form a transfer path for recording material A, and pressing rollers 152 and 152a arranged along heat plate 150 at approximately constant intervals, wherein recording material A is heat developed with heat plate 150 while transferring recording material A with pressing rollers 152 and 152a, as shown in FIG. 4, in addition to the above-mentioned constitution that recording material A is heated and transferred with heating drum 68 and endless belt 70.

In this case, transferring roller pairs 140 are also disposed downwards from peeling portion 72 formed by heat plate 150 and pressing roiler 152*a* of the most downstream side, at the above-mentioned distance H.

Curved guide plate 142 is disposed downwards (on the downstream side in the transferring direction) from transfer roller pairs 140, and discharge roller pairs 144 is arranged at a lower end thereof to form a discharge path. Heat-developed recording material A is collected in tray 146 through this discharge path.

Recording material A will be described in detail below.

A heat-developable light-sensitive recording material (hereinafter referred to as "first recording material") comprises a support having on one side of the support an image-forming layer comprising a binder 50% or more of which is a latex and an organic silver salt-reducing agent.

When the first recording material is exposed, a photocatalyst such as light-sensitive silver halide forms a latent image nucleus, and when the material is heated, silver of an organic silver salt which is ionized by the function of a reducing agent migrates and combined with light-sensitive silver halide to form crystal silver, thereby an image is formed.

The organic silver salt contained in the image-forming layer of this recording material is comparatively stable against light, but it is a silver salt which forms a silver image when heated at 80° C. or more in the presence of an exposed photocatalyst (a latent image of light-sensitive silver halide, etc.) and a reducing agent, and it may be desalted, if necessary.

Examples of such organic silver salts include silver salts of organic acids (preferably silver salts of long chain fatty carboxylic acid having from 10 to 30 carbon atoms) and complexes of organic and inorganic silver salts ligands of which have complex stability constant of from 4.0 to 10.0, specifically silver behenate, silver arachidate, silver stearate, silver oleate, silver laurate, silver caproate, silver myristate, silver palmitate, silver maleate, silver fumarate, silver tartrate, silver linoleate, silver butyrate and silver camphorate.

Also, silver salts of compounds containing a mercapto group or a thione group and derivatives of these compounds can also be preferably used as such organic silver salts. Specific examples thereof include silver salts of 3-mercapto-4-phenyl-1,2,4-triazole, silver salts of 2-mercaptobenzimidazole, silver salts of 2-mercapto-5-aminothiadiazole, silver salts of thioglycolic acid (e.g., S-alkylthioglycolic acid), silver salts of dithiocarboxylic acid (e.g., silver salts of dithioacetic acid), silver salts of thioamide, silver salts of 5-carboxyl-1-methyl-2-phenyl-4-thiopyridine, silver salts of mercaptotriazine, and silver salts of 2-mercaptobenzoxazole.

Configurations of such the organic silver salts are preferably acicular crystals having a short axis and a long axis, specifically having a short axis of from 0.01 to 0.20 $\mu$m and a long axis of from 0.10 to 5.0 $\mu$m.

Organic silver salts are preferably monodisperse, specifically the percentages of the values obtained by dividing standard deviations of each of a short axis and a long axis by the values of a short axis and a long axis, respectively are preferably 100% or less.

It is preferred to make these organic silver salts solid fine particle dispersion using a well-known dispersant, e.g., polyacrylic acid, polyvinyl alcohol, polyvinyl pyrrolidone, etc., with a view to obtaining fine particles having a small particle size and free of agglomeration.

Solid fine particle dispersion of organic silver salts can be obtained according to well-known mechanical fine particle dispersion methods using a ball mill, a vibrating ball mill, etc., in the presence of a dispersant.

Besides mechanical dispersion methods, solid fine particle dispersion can be obtained by roughly dispersing an organic silver salt in a solvent and then varying pH in the presence of a dispersing aid.

The amount of organic silver salts is preferably from 0.1 to 5 g/liter and more preferably from 1 to 3 g/liter in terms of silver amount.

As reducing agents for reducing organic silver salts, arbitrary compounds capable of reducing silver ions to metal silver can be used, preferably an organic compound. Various kinds of well-known reducing agents which are used for recording materials using organic silver salts, e.g., those disclosed in Japanese Patent Application No. 57-82829, JP-A-6-3793 (the term "JP-A" as used herein means an "unexamined published Japanese patent application"), and U.S. Pat. No. 5,464,738 can be used as such the reducing agents.

Specific examples include amidoxime, e.g., phenyl amidoxime; azine, e.g., 4-hydroxy-3,5-dimethoxybenzaldehyde azine; hydroxamic acid, e.g., phenylhydroxamic acid; $\alpha$-cyanophenyl acetic acid derivatives, e.g., ethyl-$\alpha$-cyano-2-methylphenylacetate; bis-$\beta$-naphthol, e.g., 2,2'-dihydroxy- 1,1'-binaphthyl; 5-pyrazolone, e.g., 3-methyl-1-phenyl-5-pyrazolone; reductone, e.g., dimethylaminohexose reductone; sulfonamidophenol reducing agents, e.g., 2,6-dichloro-4-benzenesulfonamidophenol; chroman, e.g., 2,2-dimethyl-7-t-butyl-6-hydroxychroman; 1,4-dihydropyridine, e.g., 2,6-dimethoxy-3,5-dicarboethoxy-1,4-dihydropyridine; bisphenol, e.g., bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives, e.g., 1-ascorbyl palmitate; and chromanol (tocophenol); and bisphenol and chromanol are particularly preferably used.

In addition to the above, well-known photographic developers such as Phenidone®, hydroquinone and catechol are preferably used, and hindered phenol reducing agents are particularly preferably used.

Reducing agents may be added in the same manner as the addition of a solution, a powder or a solid fine particle dispersion. Dispersion of solid fine particles is performed by well-known fine dispersion methods (e.g., using a ball mill, a vibrating ball mill, and the like). A dispersing aid may be used in solid fine particle dispersion.

The amount of reducing agents is preferably from 5 to 50 mol % per mol of silver of the side on which an image-forming layer is provided. A reducing agent is fundamentally added to an image-forming layer but may be added to other layers on the same side on which an image-forming layer is provided. In such a case, a reducing agent is preferably added in a little lots of amount, e.g., from 10 to 50 mol %. Further, a reducing agent may be in the form of a precursor which is induced so as to effectively exhibit a function only at development time.

The image-forming layer of this recording material contains a substance which becomes a photocatalyst when exposed, e.g., light-sensitive silver halide (hereinafter referred to as silver halides).

The composition of silver halide is not restricted and any of silver chloride, silver chlorobromide, silver bromide, silver iodobromide, silver iodochlorobromide and silver iodide can be used, but silver bromide and silver iodobromide are preferably used.

The grain size of these silver halide is preferably 0.20 $\mu$m or less for preventing white turbidity after image formation and in particular cubic grains and tabular grains are preferred.

It is preferred for silver halide grains to contain at least one metal complex selected from rhodium, rhenium, ruthenium, osmium, iridium, cobalt, mercury and iron in an amount of from 1 nmol to 10 mmol per mol of silver. These metal complexes are disclosed in detail in JP-A-7-22549.

Metal complexes may be contained in silver halide uniformly or may be contained locally in a core part or a shell part in high concentration, and the contained phase is not particularly limited.

Silver halide grains are preferably chemically sensitized.

Methods of chemical sensitization are not particularly limited and, for example, a sulfur sensitization method, a selenium sensitization method, a tellurium sensitization method using diacyl tellurides and bis(oxycarbonyl) tellurides, a noble metal sensitization method using chloroauric acid and potassium chloroaurate, a reduction sensitization method, using ascorbic acid and thiourea dioxide can be used.

A method of ripening while maintaining the pH of the emulsion 7 or more and pAg of the emulsion 8.3 or less, and a reduction sensitization method of introducing a single addition part of the silver ion during the grain formation are also usable.

The addition amount of these silver halides is preferably from 0.01 to 0.5 mol per mol of the organic silver salt.

When silver halide and organic silver salt are prepared separately, silver halide grains and organic silver salt as prepared may be mixed using a high speed stirrer, a ball mill, a sand mill, a colloid mill, a vibrating mill, a homogenizer, etc., or silver halide grains as prepared may be mixed with organic silver salt at appropriate time during preparation of organic silver salt.

Further, with respect to preparation of silver halide and a mixing method with an organic silver salt, so-called halidation comprising halogenizing a part of silver of an organic silver salt with an organic or inorganic halide is also preferably used. Examples of organic halides for use thereat include N-halogenoimide (e.g., N-bromosuccinimide) and a halogenated quaternary nitrogen compound (e.g., tetrabutylammonium bromide), and examples of inorganic halides include halogenated alkali metals (e.g., lithium bromide and potassium iodide), halogenated ammonium (e.g., ammonium bromide), halogenated alkaline earth metals (e.g., calcium bromide), and halogen molecules (e.g., bromine and iodine). The addition amount of halides at halidation is from 1 to 500 mmol per mol of the organic silver salt in terms of a halogen atom.

The image-forming layer of this recording material contains a latex comprising a water-insoluble hydrophobic polymer dispersed in a water-soluble dispersion medium as fine particles in an amount of 50 wt % or more based on the entire binder. Moreover, other layers may have the same constitution, if necessary.

The state of latex dispersion may be any of the dispersion in which a polymer is emulsified in a dispersion medium, the emulsion polymerization dispersion, the micelle dispersion, or the dispersion in which a polymer molecule has partially hydrophilic constitution and the molecular chain itself is molecularly dispersed. Further, a core/shell type latex may be used as well as a generally used latex having homogeneous constitution.

These lattices are described in Taira Okuda, Hiroshi Inagaki, *Synthetic Resin Emulsion*, published by Kobunshi Kanko-kai (1978), Takaaki Sugimura, Yasuo Kataoka, Soichi Suzuki, Keiji Kasahara, *Application of Synthetic Latex*, published by Kobunshi Kanko-kai (1993), Soichi Muroi, *Chemistry of Synthetic Latex*, published by Kobunshi Kanko-kai (1970), etc.

As polymers of these latices, acrylic resins, vinyl acetate resins, polyester resins, polyurethane resins, rubber resins, vinyl chloride resins, vinylidene chloride resins, polyolefin resins, etc., can be exemplified.

These polymers may be straight chain or branched, or may be crosslinked. Polymers may be homopolymers which are polymers of single monomers or copolymers which are polymers of two or more kinds of monomers. Either of a random copolymer or a block copolymer may be used as a copolymer.

The number average molecular weight of the polymers is from 5,000 to 1,000,000, preferably from 10,000 to 100,000. If the molecular weight is too small, mechanical strength of the light-sensitive layer is insufficient and if it is too large, film-forming property is disadvantageously deteriorated.

Specific examples of these polymers include methyl methacrylate/ethyl acrylate/methacrylic acid copolymers, methyl methacrylate/2-ethylhexyl acrylate/styrene/acrylic acid copolymers, styrene/butadiene/acrylic acid copolymers, styrene/butadiene/divinylbenzene/methacrylic acid copolymers, methyl methacrylate/vinyl chloride/acrylic acid copolymers, vinylidene chloride/ethyl acrylate/acrylonitrile/methacrylic acid copolymers, etc.

Various commercially available polymers can also be used. There are exemplified, for example, as an acrylic resin, Cebian A-4635, etc. (manufactured by Daicel Chemical Industries Ltd.), as a polyester resin, FINETEX ES650, etc. (manufactured by Dainippon Chemicals and Ink Co., Ltd.), as a polyurethane resin, HYDRAN AP10, etc. (manufactured by Dainippon Chemicals and Ink Co., Ltd.), as a rubber resin, LACSTAR 7310K, etc. (manufactured by Dainippon Chemicals and Ink Co., Ltd.), as a vinyl chloride resin, G351, etc. (manufactured by Nippon Zeon Co., Ltd.), as a vinylidene chloride resin, L502, etc. (manufactured by Asahi Chemical Industry Co., Ltd.), and as a polyolefin resin, Chemipearl S120, etc. (manufactured by Mitsui Petrochemical Industries, Ltd.).

These polymers may be used alone or two or more kinds may be blended before use, if necessary.

The average particle size of dispersed particles in a latex is preferably from about 1 to about 50,000 nm, more preferably from about 5 to about 1,000 nm. The particle size distribution of dispersed particles is not particularly restricted and those having broad particle size distribution and monodisperse particle size distribution may be used.

The minimum film forming temperature (MFT) of the latex is preferably from −30 to 90° C., more preferably from 0 to 70° C.

As described above, the image-forming layer of this recording material preferably comprises 50 wt % or more, particularly preferably 70 wt % or more, of latex based on the entire binder.

Moreover, this image-forming layer may contain, if necessary, hydrophilic polymers such as gelatin, polyvinyl alcohol, methyl cellulose, hydroxypropyl cellulose, carboxy-methyl cellulose, or hydroxypropylmethyl cellulose, within the range of 50 wt % or less based on the entire binder. The addition amount of these hydrophilic polymers is preferably 30 wt % or less based on the entire binder amount in the light-sensitive layer.

Further, dispersed particles of latices (polymers) preferably have equilibrium moisture content at 25° C., 60% RH of 2 wt % or less, more preferably 1 wt % or less.

The image-forming layer of this recording material or other layers on the same side on which the image-forming layer is provided preferably contains additives known as a color toning agent in an amount of preferably from 0.1 to 50 mol % per mol of silver for purpose of improving optical density. The color toning agent may be in the form of a precursor which is induced so as to effectively exhibit a function only at development time.

Various well-known color toning agent which are used in recording materials can be used in the present invention, and specific examples of such the color toning agent include a phthalimide compound (e.g., phthalimide, N-hydroxy-phthalimide, etc.); cyclic imide (e.g., succinimide, pyrazolin-5-one, etc.); naphthalimide (e.g., N-hydroxy-1,8-naphthalimide, etc.); a cobalt complex (e.g., cobalt hexaminetrifluoroacetate, etc.); mercaptan (e.g., 3-mercapto-1,2,4-triazole, 2,4-dimercaptopyrimidine, etc.); and a phthalazinone derivative (e.g., 4-(1-naphthyl) phthalazinone), and metal salts thereof, etc.; and these compounds are added to a coating solution as a solution, a powder, or a solid fine particle dispersion.

In the recording material having such an image-forming layer, the image-forming layer and/or other layers may contain, if necessary, a sensitizing dye in an amount of preferably from about $10^{-6}$ to about 1 mol per mol of the silver halide in the image-forming layer.

Any sensitizing dyes can be used so long as they can spectrally sensitize silver halide grains in desired wavelength region when adsorbed onto silver halide grains, e.g., examples of the sensitizing dye include a cyanine dye, a merocyanine dye, a complex cyanine dye, a complex merocyanine dye, a holopolar cyanine dye, a styryl dye, a hemicyanine dye, an oxonol dye and a hemioxonol dye. That is, a sensitizing dye having spectral sensitivity suitable for spectral characteristics of recording light L can be selected.

Addition of sensitizing dyes to a silver halide emulsion is effected by directly dispersing them to an emulsion or may be added to an emulsion by dissolving them in a single solution or a mixed solution of water, methanol, ethanol, N,N-dimethylformamide, etc.

The image-forming layer and/or other layers of this recording material may contain an antifoggant, a stabilizer, a stabilizer precursor, etc., for purpose of preventing generation of additional fog or reduction of sensitivity during storage.

Examples of antifoggants, stabilizers, stabilizer precursors include thiazonium salts disclosed in U.S. Pat. No. 2,131,038, azaindenes disclosed in U.S. Pat. No. 2,886,437, mercury salts disclosed in U.S. Pat. No. 2,728,663, and urazols disclosed in U.S. Pat. No. 3,287,135. Also as an antifoggant, organic halides disclosed in JP-A-50-119624 and JP-A-8-15809 can be preferably used.

An antifoggant may be added to a coating solution as a solution, a powder, or a solid fine particle dispersion.

The image-forming layer and/or other layers of this recording material may contain benzoic acids for purpose of increasing sensitivity or preventing fog.

Various kinds of benzoic acid derivatives can be used as benzoic acids and preferred examples thereof include compounds disclosed in U.S. Pat. No. 4,787,939 and Japanese Patent Application No. 8-151242. These compounds are added to a coating solution as a powder, a solution, or a fine particle dispersion.

The addition amount of benzoic acids is not particularly limited but the amount of from about 1 $\mu$mol to about 2 mol per mol of silver is preferred.

The image-forming layer and/or other layers of this recording material may contain mercapto compounds, disulfide compounds and thione compounds for purpose of inhibiting or accelerating development, improving spectral sensitization efficiency, improving storage stability before and after development.

Mercapto compounds having any structure can be used but those represented by the formula Ar—SM or Ar—S—S—Ar (wherein M represents a hydrogen atom or an alkali metal atom; Ar represents an aromatic ring or a condensed aromatic ring containing 1 or more of nitrogen, sulfur, oxygen, selenium or tellurium) are preferably used. Specific examples thereof include 2-mercaptobenzimidazole, 2-mercaptobenzoxazole, 2-mercaptobenzothiazole, 2-mercapto- 5-methylbenzimidazole, 6-ethoxy-2-mercaptobenzothiazole, 4,5-diphenyl-2-imidazolethiol, and 2-mercaptoimidazole.

The addition amount of mercapto compounds is preferably from about 0.001 to about 1.0 mol per mol of silver.

The image-forming layer and/or other layers of this recording material may contain various dyes and pigments for purpose of color tone improvement and irradiation prevention.

Any dye and pigment can be used in the present invention, for example, dyes and pigments described in color index, specifically organic and inorganic pigments, such as a pyrazoloazole dye, an anthraquinone dye, an azo dye, an azomethine dye, an oxonol dye, a carbocyanine dye, a styryl dye, a triphenylmethane dye, an indoaniline dye, an indophenol dye, a phthalocyanine dye can be exemplified. They are added to a coating solution in the form of a solution, an emulsion, or a solid fine particle dispersion, or they are mordanted by a high polymer mordant and added to a coating solution.

The amount of these compounds to be used is determined according to the objective absorption amount, but is generally from about 1 $\mu$g to about 1 g per liter of the coating solution.

Further, the image-forming layer and/or other layers of this recording material may contain, in addition to the above compounds, a plasticizer and a lubricant (e.g., glycerines and diols disclosed in U.S. Pat. No. 2,960,404), a super-high contrasting agent (e.g., hydrazine derivatives disclosed in Japanese Patent Application No. 8-148116), a high contrast accelerator (e.g., onium salts disclosed in Japanese Patent Application No. 8-132836), and a hardening agent (e.g., polyisocyanates disclosed in JP-A-6-208193).

This recording material may contain various layers in addition to the image-forming layer.

For example, a surface protective layer can be provided for protecting the image-forming layer and preventing adhesion. The surface protective layer is formed of adhesion-preventing materials. Fox example, a wax, silica grains, a styrene-containing elastomeric block copolymer (e.g., styrene/butadiene/styrene), cellulose acetate, cellulose acetate butyrate, cellulose propionate, etc., can be used.

Moreover, an antihalation layer may be provided.

An antihalation layer preferably has a maximum absorption of from 0.3 to 2 in a desired wavelength region and an absorption of from 0.001 to 0.5 in the visible region after processing.

When halation preventing dyes are used, any compound can be used as such a halation preventing dye so long as the dye has objective absorption in a desired wavelength region, an absorption in the visible region after processing is sufficiently little, and preferred spectral shape of absorbance of the antihalation layer can be obtained. For example, the following dyes are exemplified but the present invention is not limited thereto. As a single dye, compounds disclosed in JP-A-7-11432 and JP-A-7-13295, and as a dye which is decolored by processing, compounds disclosed in JP-A-52-139136 and JP-A-7-199409 can be exemplified.

This recording material preferably has an image-forming layer on one side and a backing layer (a back coating layer) on the other side.

A matting agent may be added to a backing layer for improving conveyance property. A matting agent is, in general, fine particles of a water-insoluble organic or inorganic compound. As such an organic compound, preferred examples of vinyl polymers dispersible in water include polymethyl acrylate, methyl cellulose, carboxyl starch, and carboxynitrophenyl starch, and preferred examples of inorganic compounds include silicon dioxide, titanium dioxide, magnesium dioxide, aluminum oxide, and barium sulfate.

The size and shape of the matting agent are not particularly restricted but those having a particle size of from 0.1 to 30 $\mu$m are preferably used. Further, as matting degree of a backing layer, Bekk smoothness (degree) of from 250 to 10 sec. is preferred.

As binders for forming a backing layer, colorless, transparent or translucent various resins can be used, e.g., gelatin, gum arabic, polyvinyl alcohol, hydroxyethyl cellulose, cellulose acetate, cellulose acetate butyrate, casein, starch, poly(meth)acrylic acid, polymethyl methacrylic acid, polyvinyl chloride, etc.

Further, a backing layer preferably has a maximum absorption of from 0.3 to 2 in a desired wavelength region and halation preventing dyes which are used in the foregoing antihalation layer may be added in the backing layer.

A backside resistive heating layer as disclosed in U.S. Pat. No. 4,460,681 and U.S. Pat. No. 4,374,921 may be provided on the same side on which a backing layer is provided.

In addition to the above layers, this recording material may have an antistatic or electrically conductive layer containing soluble salts (e.g., chloride, nitrate), a deposited metal layer, a layer containing ionic polymers as disclosed in U.S. Pat. No. 2,861,056, and a layer containing insoluble inorganic salts as disclosed in U.S. Pat. No. 3,428,451.

As another example of the recording material for use in the apparatus according to the present invention, the following light-sensitive heat-sensitive recording material can be exemplified. This light-sensitive heat-sensitive recording material (hereinafter referred to as "second recording material") is a recording material comprising a support having provided thereon a light-sensitive heat-sensitive recording layer, wherein the light-sensitive heat-sensitive recording layer contains an encapsulated electron donating colorless dye in a heat-responsible microcapsule, and outside the heat-responsible microcapsule, a compound having an electron accepting part and a polymerizable vinyl monomer part in the same molecule, and a photopolymerization initiator.

As still further example of the recording material for use in the apparatus according to the present invention, the following recording material can be exemplified (hereinafter referred to as "third recording material"), which comprises a support having provided thereon a light-sensitive heat-sensitive recording layer, wherein the light-sensitive heat-sensitive recording layer contains an electron donating colorless dye encapsulated in a heat-responsible microcapsule, and outside the heat-responsible microcapsule, an electron accepting compound, a polymerizable vinyl monomer, and a photopolymerization initiator.

When these recording materials are exposed, composition outside the heat-responsible microcapsule (hereinafter referred to as "photo-curable composition") is set and fixed, and the compound having an electron accepting part and a polymerizable vinyl monomer part or the electron accepting compound becomes movable by heating (not fixed) and migrates in the light-sensitive heat-sensitive recording layer to cause color development (i.e., color formation) of the microencapsulated electron donating colorless dye, thereby an image is formed.

The compound having an electron accepting part and a polymerizable vinyl monomer part in the same molecule for use in the photo-curable composition of the second recording material is a composition containing an electron acceptable group and a vinyl group in one molecule.

Specific examples thereof which can be preferably used in the present invention include styrenesulfonylamino-salicylic acid, vinylbenzyloxyphthalic acid, zinc β-(meth) acryloxyethoxysalicylate, vinyloxyethyloxybenzoic acid, β-(meth)acryloxyethylorsellinate, β-(meth) acryloxyethoxyphenol, (meth)acryloxyethyl-β-resorcinate, hydroxystyrenesulfonic acid-N-ethylamide, β-(meth) acryloxypropyl-p-hydroxybenzoate, (meth) acryloxymethylphenol, (meth)acrylamidopropanesulfonic acid, β-(meth)acryloxyethoxy-dihydroxybenzene, γ-styrene-sulfonyloxy-β-(meth)acryloxypropanecarboxylic acid, γ-(meth)-acryloxypropyl-α-hydroxyethyloxysalicylic acid, β-hydroxy-ethoxycarbonylphenol, 3,5-distyrenesulfonic acid amidophenol, (meth) acryloxyethoxyphthalic acid, (meth)acrylic acid, (meth) acryloxyethoxyhydroxynaphthoic acid, β-(meth)acryloxyethyl-p-hydroxybenzoate, β'-(meth)acryloxyethyl-β-resorcinate, β-(meth) acryloxyethyloxycarbonylhydroxybenzoic acid, and metal salts of these compounds (e.g., zinc salt).

These compounds can also be used preferably as a polymerizable vinyl monomer of the photo-curable composition in the third recording material.

As the polymerizable vinyl monomers for use in the third recording material, various monomers having at least one vinyl group in the molecule are usable, for example, (meth) acrylic acid and the salt thereof, (meth)acrylates, (meth) acrylamides; maleic anhydride, maleates; itaconic acid, itaconates; styrenes; vinyl ether and esters; N-vinyl heterocyclic rings; and allyl ether and esters can be used. In particular, monomers having a plurality of vinyl groups in the molecule are preferably used, e.g., (meth)acrylates of polyhydric alcohols, polyhydric phenols, (meth)acrylates of bisphenols, (meth)acrylate-terminated epoxy resins, and (meth)acrylate-terminated polyesters. Specific examples thereof include ethylene glycol diacrylate, ethylene glycol dimethacrylate, trimethylolpropane triacrylate, pentaerythritol tetraacrylate, dipentaerythritol hydroxypenta-acrylate, hexanediol-1,5-dimethacrylate, and diethylene glycol dimethacrylate.

These monomers preferably have a molecular weight of about 100 to about 5,000.

Photopolymerization initiators which are used in the second and third recording materials (hereinafter referred to as "recording materials" together) are compounds capable of initiating photopolymerization of the above-described vinyl monomer, and when used in combination with green-, red- to infrared-absorbing dyes, they preferably have sensitivity in these wavelength regions. Organic borate compounds which are said to generate radicals by irradiation (refer to JP-A-62-143044), preferably organic borates of cationic dyes, can be exemplified as examples.

Organic borate generates radicals corresponding to a laser beam irradiated and the radicals initiate polymerization of the above-described vinyl monomer part.

Organic borate represented by formula (1) is used as a photopolymerization initiator:

(1)

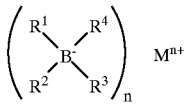

wherein M represents an alkali metal atom, quaternary ammonium, pyridinium, quinolinium, diazonium, morpholinium, tetrazolium, acridinium, phosphonium, sulfonium, oxosulfonium, sulfur, oxygen, carbon, halogenium, or a cation selected from Cu, Ag, Hg, Pd, Fe, Co, Sn, Mo, Cr, Ni, As, and Se; n represents an integer of from 1 to 6; $R^1$, $R^2$, $R^3$ and $R^4$ each represents a halogen atom, a substituted or unsubstituted alkyl group, a substituted or unsubstituted alkenyl group, a substituted or unsubstituted alkynyl group, an alicyclic group, a substituted or unsubstituted aryl group, a substituted or unsubstituted alkaryl group, a substituted or unsubstituted aryloxy group, a substituted or unsubstituted aralkyl group, a substituted or unsubstituted heterocyclic group, or a substituted or unsubstituted silyl group; $R^1$, $R^2$, $R^3$ and $R^4$ may be the same or different, and two or more of them may be bonded to form a ring.

In the above formula (1), examples of borate anions include tetraethyl borate, triisobutylmethyl borate, di-n-butyl-di-t-butyl borate, tetraphenyl borate, tetra-p-chlorophenyl borate, tri-m-chlorophenyl-n-hexyl borate, triphenylethyl borate, trimethylbutyl borate, tritolylisopropyl borate, triphenylbenzyl borate, tetraphenyl borate, tetrabenzyl borate, triphenylphenethyl borate, triphenyl-p-chlorobenzyl borate, triphenylethenyl butyl borate, di(α-naphthyl)dipropyl borate, triphenylsilyltriphenyl borate, tritoluylsilylphenyl borate, and tri-n-butyl(dimethylphenylsilyl) borate.

Examples of organic borates represented by formula (1) are shown below.

(1)

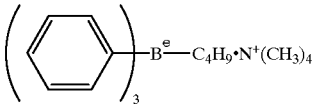

(2)

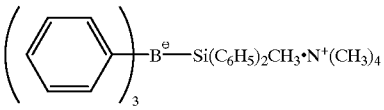

(3)

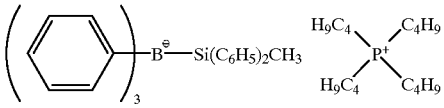

(4)

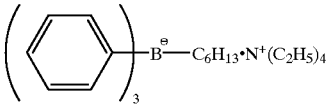

-continued (5)

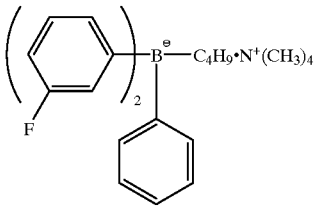

(6)

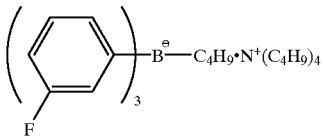

(7)

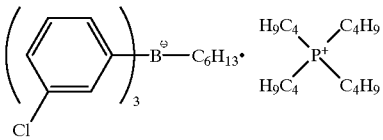

(8)

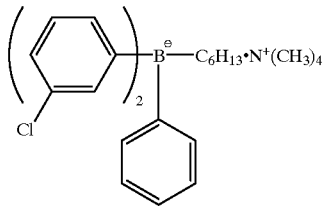

For increasing light absorption efficiency of recording light L, it is preferred to use the organic borate represented by formula (1) in combination with green-, red- to infrared-absorbing dyes as spectral sensitizing dyes.

In particular, organic cationic dyes having maximum absorption wavelength in the wavelength region of from 500 to 1,100 nm are preferably used, specifically a cationic methine dye, a cationic carbonium dye, a cationic quinoneimine dye, a cationic indoline dye, and a cationic styryl dye can be exemplified. More specific examples include, as cationic methine dyes, preferably a polymethine dye, a cyanine dye, and an azomethine dye (more preferably cyanine, carbocyanine, dicarbocyanine, tricarbocyanine, and hemicyanine); as cationic carbonium dyes, preferably a triarylmethane dye, a xanthene dye, and an acridine dye (more preferably rhodamine); as cationic quinoneimine dyes, preferably an azine dye, an oxazine dye, a thiazine dye, a quinoline dye, and a thiazole dye; and these dyes may be used alone or in combination of two or more.

Organic borate of a cationic dye represented by formula (2) is more preferably used as a photopolymerization initiator:

(2)

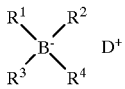

wherein $D^+$ represents a cationic dye; $R^1$, $R^2$, $R^3$ and $R^4$ each represents a halogen atom, a substituted or unsubstituted alkyl group, a substituted or unsubstituted aryl group, a substituted or unsubstituted aralkyl group, a substituted or unsubstituted alkaryl group, a substituted or unsubstituted alkenyl group, a substituted or unsubstituted alkynyl group, a substituted or unsubstituted aryloxy group, a substituted or unsubstituted alicyclic group, a substituted or unsubstituted heterocyclic group, a substituted or unsubstituted allyl group, or a substituted or unsubstituted silyl group; $R^1$, $R^2$, $R^3$ and $R^4$ may be the same or different, and two or more of them may be bonded to form a ring.

In formula (2), a cationic dye represented by $D^+$ functions as a spectral sensitizing dye, and those having absorption peak in the wavelength region of 500 nm or more, in particular, from 550 to 1,100 nm, are preferably used.

Specifically, a cationic methine dye, a cationic carbonium dye, a cationic quinoneimine dye, a cationic indoline dye, and a cationic styryl dye can be exemplified. More specific examples include, as cationic methine dyes, preferably a polymethine dye, a cyanine dye, and an azomethine dye (more preferably cyanine, carbocyanine, dicarbocyanine, tricarbocyanine, and hemicyanine); as cationic carbonium dyes, preferably a triarylmethane dye, a xanthene dye, and an acridine dye (more preferably rhodamine); as cationic quinoneimine dyes, preferably an azine dye, an oxazine dye, a thiazine dye, a quinoline dye, and a thiazole dye.

As borate anions, those exemplified as to formula (1) can be exemplified as preferred examples.

Examples of organic borates of the cationic dye represented by formula (2) are shown below.

(1)

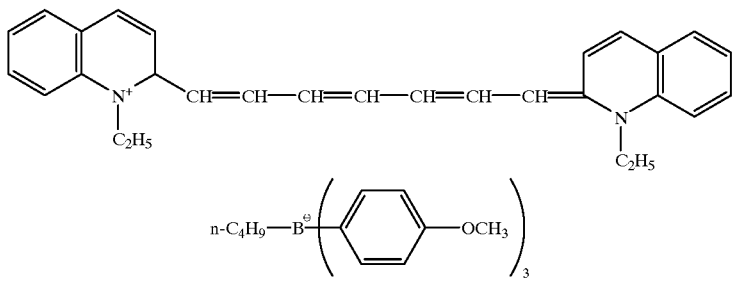

(2)

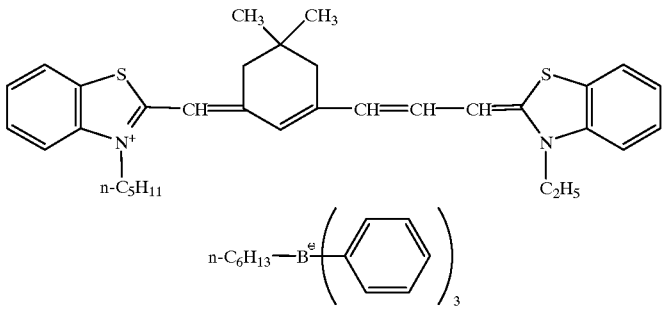

(3)

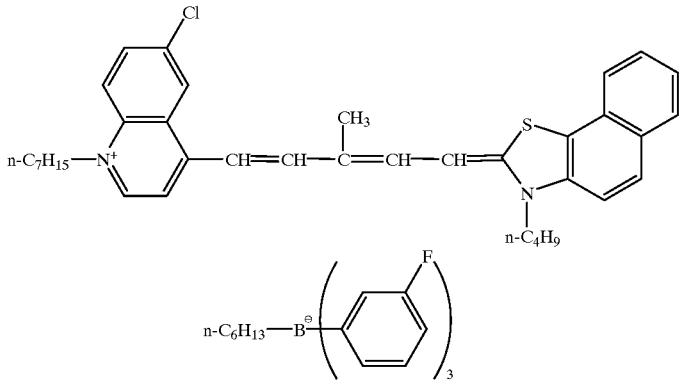

-continued (4)

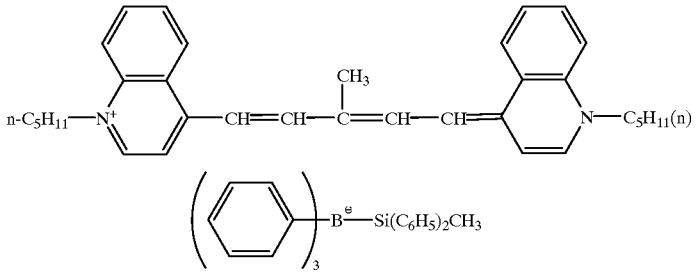

(5)

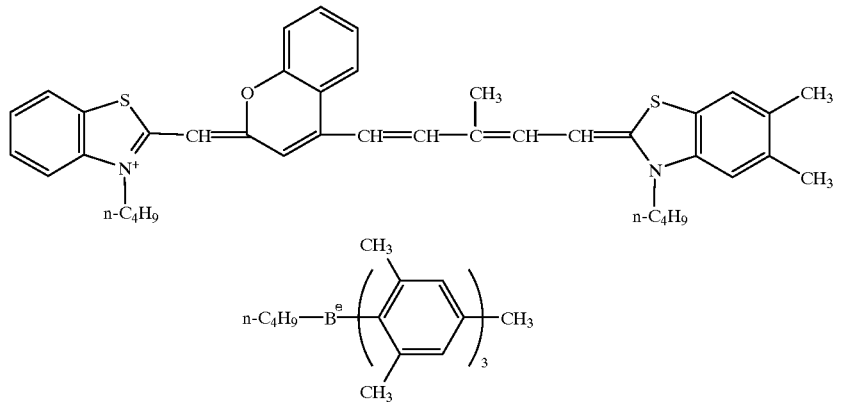

(6)

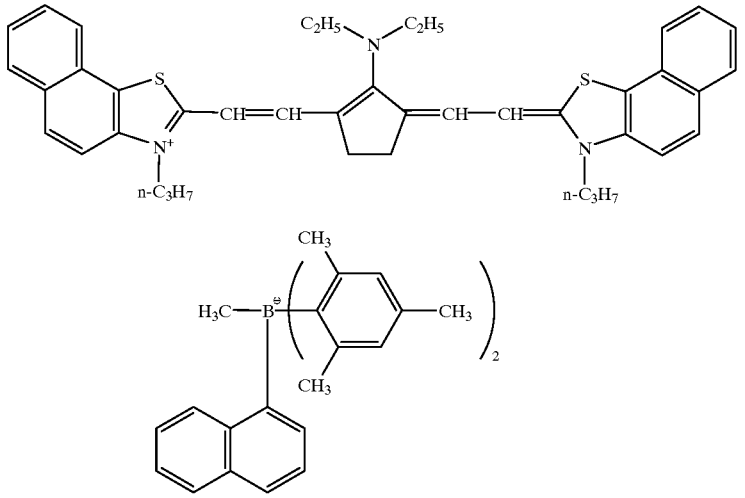

The addition amount of the photopolymerization initiator is preferably from 0.01 to 20 wt % based on the entire weight of the photo-curable composition (other than the heat-responsible microcapsule).

In these recording materials, in addition to the above-described photopolymerization initiator and spectral sensitizing dye, the compound having an active halogen group in the molecule represented by formula (3) or (4) can be used as an auxiliary:

(3)

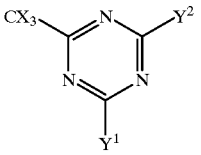

wherein X represents a halogen atom; $Y^1$ represents —$CX_3$, —$NH_2$, —NHR, —$NR_2$, or —OR; R represents an alkyl group, a substituted alkyl group, an aryl group, or a substituted aryl group; and $y^2$ represents —$CX_3$, an alkyl group, a substituted alkyl group, an aryl group, a substituted aryl group, or a substituted alkenyl group; formula (3) itself may be a substituent.

(4)

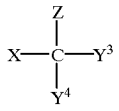

wherein X represents a halogen atom; $Y^3$ and $Y^4$, which may be the same or different, each represents a hydrogen atom or a halogen atom; and Z represents the following group:

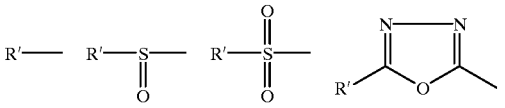

wherein R' represents a hydrogen atom, a halogen atom, an alkyl group, a substituted alkyl group, an aryl group, a substituted aryl group, a substituted alkenyl group, a heterocyclic group, or a substituted heterocyclic group.

A compound represented by formula (3) in which $Y^1$ represents $CX^3$ is preferably used.

Specific examples of the compounds represented by formula (3) include 2-phenyl-4,6-bis(trichloromethyl)-S-triazine, 2-(p-chlorophenyl)-4,6-bis(trichloromethyl)-S-triazine, 2-(p-methoxyphenyl)-4,6-bis(trichloromethyl)-S-triazine, 2,4,6-tris(trichloromethyl)-S-triazine, 2-(p-cyanophenyl)-4,6-bis(trichloromethyl)-S-triazine, and 2-(p-acetylphenyl)-4,6-bis(trichloromethyl)-S-triazine.

Examples of the compounds represented by formula (4) include carbon tetrachloride, carbon tetrabromide, iodoform, p-nitro-α,α,α-tribromoacetophenone, ψ,ψ,ψ-tribromoquinaldine, tribromomethylphenylsulfone and trichloromethylphenylsulfone.

The compound represented by formula (3) or (4) is preferably added in an amount of from 0.01 to 20 mol per mol of the spectral sensitizing dye (the cationic dye).

These recording materials are highly sensitive and infrared light-sensitive, but may contain a reducing agent, (e.g., an oxygen scavenger), a chain transferring agent of an active hydrogen donor and other compounds in combination as an auxiliary for accelerating latent image formation.

As the oxygen scavenger, which has been found to be useful as the auxiliary for accelerating latent image formation, phosphine, phosphonate, phosphite, stannous salt, and other compounds easily oxidized by oxygen (e.g., N-phenylglycine, trimethylbarbituric acid, N,N-dimethyl-2, 6-diisopropylaniline, etc.), can be exemplified.

An electron accepting compound is added to the photo-curable composition of the third recording material. An electron accepting compound may also be added to the photo-curable composition of the second recording material, if necessary, by which color density can be improved.

Examples of electron accepting compounds include a phenol derivative, a salicylic acid derivative, metal salt of aromatic carboxylic acid, acid clay, bentonite, a novolak resin, a metal-processed novolak resin, and a metal complex. As phenol derivatives, 2,2'-bis(4-hydroxyphenyl)propane, 4-t-butylphenol, 4-phenylphenol, 4-hydroxydiphenoxide, 1,1'-bis-(3-chloro-4-hydroxyphenyl)cyclohexane, and 1,1'-bis(3-chloro-4-hydroxyphenyl)-2-ethylbutane can be exemplified. As salicylic acid derivatives, 4-pentadecylsalicylic acid, 3,5-di(α-methylbenzyl)salicylic acid, 3,5-di(tert-octyl) salicylic acid, 5-octadecylsalicylic acid, 5-α-(p-α-methylbenzyl-phenyl)ethylsalicylic acid, 3-α-methylbenzyl-5-tert-octyl-salicylic acid, and 5-tetradecylsalicylic acid can be exemplified.

The amount of the electron accepting compound is preferably from 5 to 1,000 wt % based on the weight of the electron donating colorless dye.

In addition to these compounds, as a photo-crosslinkable composition, e.g., polyvinyl cinnamate, polyvinyl cinnamylideneacetate, a photo-curable composition having an α-phenylmaleimido group can be added to the photo-curable composition of the recording materials. These photo-crosslinkable compositions can be used as a photo-curable component.

As well as the above compounds, if necessary, a thermal polymerization inhibitor may be added to the photo-curable composition of the recording materials for purposes of preventing thermal and aging polymerization of the photo-curable composition and improving stability.

Preferred examples of thermal polymerization inhibitors include p-methoxyphenol, hydroquinone, t-butyl-catechol, pyrogallol, 2-hydroxybenzophenone, 4-methoxy-2-hydroxybenzophenone, cuprous chloride, phenothiazine, chloranil, naphthylamine, β-naphthol, 2,6-di-t-butyl-p-cresol, nitrobenzene, dinitrobenzene, piclic acid, and p-toluidine, and a thermal polymerization inhibitor is preferably added in an amount of from about 0.001 to about 5 wt % based on the entire weight of the photo-curable composition.

The photo-curable composition is emulsification dispersed and added to the light-sensitive heat-sensitive recording layer.

Examples of solvents for emulsification dispersing the photo-curable composition include cotton seed oil, kerosine, aliphatic ketone, aliphatic ester, paraffin, naphthene oil, alkylated biphenyl, chlorinated paraffin, diarylethane (e.g., 1,1'-ditolylethane), alkyl phthalate (e.g., dibutyl phthalate), phosphate (e.g., diphenyl phosphate), citrate (e.g., acetyl tributyl citrate), benzoate (e.g., octyl benzoate), alkylamide (e.g., diethyllaurylamide), acetate (e.g., ethyl acetate), acrylate (including methacrylate) (e.g., methyl acrylate), alkyl halide (e.g., methylene chloride and carbon tetrachloride), methyl isobutyl ketone, β-ethoxyethyl acetate, and methyl cellosolve acetate. Among these compounds, aliphatic esters and alkyl halides are particularly preferred, and those having the solubility in water of 10 vol % or less is more preferred.

It is preferred to use these solvents at the rate of from 1 to 500 weight parts based on the photopolymerizable compound.

Further, as a water-soluble high polymer molecule which can be used in emulsification dispersion of the photo-curable composition, compounds having the solubility of 5 wt % or more in water of 25° C. are preferred, specifically gelatin, gelatin derivatives, protein (e.g., albumin), cellulose derivatives (e.g., methyl cellulose), sugar derivatives (e.g., starches (including modified starches)), polyvinyl alcohol, a hydrolyzed product of styrene-maleic anhydride copolymer, carboxyl-modified polyvinyl alcohol, polyacrylamide, a saponified product of vinyl acetate-polyacrylic acid copolymer, and synthetic high polymer molecule (e.g., polystyrene sulfonate) can be exemplified and gelatin and polyvinyl alcohol are particularly preferred. on the other hand, microencapsulated electron donating colorless dyes added to the light-sensitive heat-sensitive recording layer of the recording material according to the present invention can be produced using various well-known compounds (e.g., triphenylmethane phthalide compounds, fluoran compounds, phenothiazine compounds, indolyl phthalide compounds, leuco auramine compounds, rhodamine lactam compounds, triphenylmethane compounds, triazene compounds, spiro-pyran compounds, or fluorene compounds).

Specifically, as triphenylmethane phthalide compounds, 3,3-bis(p-dimethylaminophenyl)-6-dimethylamino phthalide and 3-(p-dimethylaminophenyl)-3-(2-methylindol-3-yl) phthalide; as leuco auramine compounds, N-halophenyl-leuco auramine and N-2,4,5-trichlorophenyl leuco auramine; as rhodamine lactam compounds, rhodamine-B-anilinolactam and rhodamine-(p-nitrino)lactam; as fluoran compounds, 2-(dibenzylamino)fluoran, 2-anilino-3-methyl-6-diethylamino-fluoran, and 2-anilino-3-methyl-6-N-methyl-N-cyclohexylamino-fluoran; as phenothiazine compounds, benzyl leuco methylene blue and p-nitrobenzyl leuco methylene blue; as spiro-pyran compounds, 3-methyl-spiro-dinaphthopyran and 3,3'-dichloro-spiro-dinaphthopyran can be exemplified.

When these recording materials are used as a full color recording material, with respect to electron donating colorless dyes for cyan, magenta and yellow, U.S. Pat. No. 4,900,149, as to a yellow coloring type, U.S. Pat. No. 4,800,148, and as to a cyan coloring type, JP-A-63-53542 can be referred to, respectively.

Microencapsulation of these electron donating colorless dyes can be carried out according to well-known techniques in the industry.

For example, the method of using coacervation of hydrophilic wall-forming materials as disclosed in U.S. Pat. No. 2,800,457, the method of interfacial polymerization as disclosed in JP-B-42-771 (the term "JP-B" as used herein means an "examined Japanese patent publication"), the method according to polymer precipitation as disclosed in U.S. Pat. No. 3,660,304, the method using isocyanate polyol wall-forming materials as disclosed in U.S. Pat. No. 3,796,669, the method using isocyanate wall-forming materials as disclosed in U.S. Pat. No. 3,914,511, and the method using urea-formaldehyde-resorcinol wall-forming materials as disclosed in U.S. Pat. No. 4,089,802 are exemplified. In particular, emulsifying the core material, then forming a high polymer film as a microcapsule wall is preferred.

Above all, a microcapsulation method of polymerization by the reactant from the inside of oil droplets is preferred in view of capable of obtaining a recording material containing microcapsules having a uniform particle size and being excellent in storage stability within a short period of time.

For example, when polyurethane is used as a capsule wall material, polyvalent isocyanate and the second material (e.g., polyol, polyamine) which reacts with the polyvalent isocyanate to form a capsule wall are mixed in an oily solution to be capsulated and emulsification dispersed in water, then the reaction temperature is increased, thereby a high polymer-forming reaction occurs at the interface of oil droplets, thus, a microcapsule wall is formed. At this time an auxiliary solvent of low boiling point having high solubility can be used in the oily solution.

As polyvalent isocyanates for use in this case, various polyvalent isocyanates for use in manufacture of well-known urethane resins can be used, such as m-phenylene-diisocyanate, 2,6-tolylenediisocyanate, 2,4-tolylene-diisocyanate, diphenylmethane-4,4-diisocyanate, xylylene-1,4-diisocyanate, 4,4'-diphenylpropanediisocyanate, trimethylenediisocyanate, hexamethylenediisocyanate, etc. Polyvalent isocyanates can also produce high polymer compound by reacting with water.

Various polyols for use in manufacturing well-known urethane resins can be used in the present invention, such as aliphatic and aromatic polyhydric alcohols, hydroxy polyester, hydroxypolyalkylene ether, etc. Examples thereof include ethylene glycol, 1,3-propanediol, 1,4-butanediol, 1,5-pentanediol, 1,6-hexanediol, propylene glycol, 2,3-dihydroxybutane, 1,2-dihydroxybutane, 2,5-hexanediol, 3-methyl-1,5-pentanediol, dihydroxycyclohexane, etc. Polyols are preferably used in the rate of the hydroxyl group of from about 0.02 to about 2 mol per mol of isocyanate.

Examples of polyamines for use in the present invention include ethylenediamine, trimethylenediamine, tetramethylenediamine, pentamethylenediamine, hexamethylenediamine, p-(m-)phenylenediamine, piperazine and derivatives thereof, 2-hydroxytrimethylenediamine, diethylenetriamine, triethylenetriamine, triethylenetetramine, tetraethylenepentamine, amine adducts of epoxy compounds, etc.

Microcapsules can also be produced using water-soluble high polymer compounds and in this case the water-soluble high polymer compounds may be any of a water-soluble anionic high polymer compound, nonionic high polymer compound, and ampholytic high polymer compound.

Examples of anionic high polymer compounds include those having a —COO— group, an —$SO_2$— group, etc., such as specifically gum arabic, alginic acid, sulfated starch, sulfated cellulose, gelatin derivative of phthalated gelatin, acrylic acid (methacrylic acid) (co)polymers, vinylbenzene-sulfonic acid (co)polymers, carboxyl-modified polyvinyl alcohol, etc.

Examples of nonionic high polymer compounds include polyvinyl alcohol, hydroxyethyl cellulose, methyl cellulose, etc.

Examples of ampholytic high polymer compounds include gelatin, etc. Among these, gelatin, gelatin derivatives and polyvinyl alcohol are particularly preferred.

Water-soluble high polymer compounds are used as an aqueous solution of from 0.01 to 10 wt %.

In the recording materials of the present invention, the average particle size of capsules is 20 $\mu$m or less, and 5 $\mu$m or less is particularly preferred in view of resolution. If capsules are too small, the surface area per a certain solid content becomes large and a large quantity of a capsule material is necessary, therefore, the average particle size of capsules is preferably 0.1 $\mu$m or less.

An electron donating colorless dye may be present as a solution in a microcapsule or may be present in the solid state.

When an electron donating colorless dye is encapsulated as a solution, it is preferred to dissolve the dye in a solvent and encapsulate. The amount of the solvent at that time is preferably from 1 to 500 weight parts per 100 weight parts of the electron donating colorless dye. The same solvent as used in the above-described emulsification of the photo-curable composition can be used at the time of microencapsulation. Further, a volatile solvent (e.g., acetate) can be used as the auxiliary solvent for dissolving the electron donating colorless dye in combination with other solvents at microencapsulation.

In addition to the light-sensitive heat-sensitive recording layer, the recording material according to the present invention may have various kinds of layers, e.g., a protective layer, an interlayer, etc., and it is preferred for the protective layer to contain a matting agent.

Examples of matting agents include inorganic particles (e.g., silica, magnesium oxide, barium sulfate, strontium sulfate, etc.), resin particles (e.g., polymethyl methacrylate, polyacrylonitrile, polystyrene, etc.), starch particles (e.g., carboxyl starch, corn starch, etc.). Among these, polymethyl methacrylate particles and silica particles are particularly preferably used. As silica particles, Siloid AL series (manufactured by Fuji-Devison Chemical Ltd.) can be used.

The particle size of the matting agent is preferably from 1 to 20 $\mu$m, and the addition amount is preferably from 2 to 500 mg/m$^2$.

It is preferred to use a curing agent in each of the light-sensitive heat-sensitive recording layer, the inter-layer and the protective layer of the recording material of the present invention. In particular, the addition of a curing agent to the protective layer to reduce the adhesion properties of the protective layer is preferred.

Gelatin hardening agent which is used in the production of photographic materials is useful as a curing agent, specifically chrome alum, zirconium sulfate, boric acid, 1,3,5-triacryloyl-hexahydro-s-triazine, 1,2-bis-vinylsulfonylmethane, 1,3-bis(vinylsulfonylmethyl)propanol-2, bis($\alpha$-vinylsulfonylacetamido)ethane, 2,4-dichloro-6-hydroxy-s-triazine sodium salt, 2,4,6-triethyleneimino-s-triazine can be exemplified.

The addition amount of the curing agent in each layer is preferably from about 0.5 to about 5 wt % based on the binder.

Colloidal silica may be added to the protective layer to reduce the adhesion properties.

As colloidal silica, for example, Snowtex 20, Snowtex 30, Snowtex C, Snowtex O, Snowtex N (manufactured by Nissan Chemical Industries Ltd.) can be used, and the addition amount is from about 5 to about 80 wt % based on the binder is preferred.

Moreover, a fluorescent whitening agent and a blue dye as a bluing agent may be added to the protective layer to increase the whiteness degree of the recording layer.

When the recording material is used as a multicolor recording material, a multilayer constitution can be employed such that each layer contains microcapsules containing electron donating colorless dyes developing in different hues and photo-curable compositions sensitive to light of different wavelengths, and an interlayer containing a filter dye may be provided between light-sensitive and heat-sensitive layers.

The interlayer primarily comprises a binder and a filter dye and contains, if necessary, additives (e.g., a curing agent and a polymer latex).

Filter dyes for use in the recording material of the present invention can be added to desirable layers, in particular, the interlayer, by the oil-in-water dispersing method or the polymer dispersing method. In the oil-in-water dispersing method, filter dyes are dissolved in a single solution or a mixed solution of a high boiling point organic solvent having a boiling point of, e.g., 175° C. or more, and an auxiliary solvent having a boiling point of, e.g., from 30 to 160° C., and then finely dispersed in an aqueous medium such as water, an aqueous gelatin solution or an aqueous solution of polyvinyl alcohol in the presence of a surfactant.

The process of the latex dispersing method and specific examples of curing and impregnation latices are disclosed in U.S. Pat. No. 4,199,383. As proper latices, e.g., copolymer latices of acrylate (methacrylate) such as ethyl acrylate and acid monomers such as acrylic acid are preferred.

In the recording material of the present invention, as binders of each layer of the protective layer, the light-sensitive heat-sensitive layer, the interlayer, etc., besides water-soluble high polymer compounds capable of being used for emulsification dispersion of photo-curable compositions and capsulation of electron donating colorless dyes, polystyrene, polyvinyl formal, polyvinyl butyral, polyvinyl alcohol, an acrylic resin (e.g., polymethyl acrylate), solvent-soluble high polymer compounds (e.g., a phenolic resin, ethyl cellulose, an epoxy resin, a urethane resin), or high polymer latices thereof, can be used. Of these, gelatin and polyvinyl alcohol are preferably used.

Each layer of the recording material may contain various kinds of surfactants for various purposes, e.g., as a coating aid, an antistatic agent, for improving sliding properties, emulsification dispersion, adhesion prevention, and the like.

As surfactants, various nonionic surfactants (e.g., saponin, polyethylene oxide and derivatives thereof); various anionic surfactants (e.g., alkylsulfonate, alkylsulfate, N-acyl-N-alkyltaurines, and sulfosuccinate); ampholytic surfactants (e.g., alkylbetaines, and alkylsulfobetaines); and cationic surfactants (e.g., aliphatic or aromatic quaternary ammonium salts), can be used according to necessity.

Further, besides the above-described additives, if necessary, dyes capable of preventing irradiation and halation, an ultraviolet absorber, a plasticizer, a fluorescent whitening agent, a coating aid, a curing agent, an antistatic agent, and a sliding property improver may be added.

These characteristic recording material having an image-forming layer or recording material having a light-sensitive heat-sensitive recording layer can be produced by preparing a coating solution (an emulsion) containing components of each layer using a solvent, if necessary, coating by well-known means and drying.

Various solvents which are used in the production of recording materials can be used, such as water, alcohols (e.g., ethanol and isopropanol), halogen-based solvents (e.g., ethylene chloride), ketones (e.g., cyclohexanone and methyl ethyl ketone), esters (e.g., methyl cellosolve acetate and ethyl acetate), toluene, xylene, etc., and if necessary, these solvents may be used as a mixture of two or more. Moreover, various surfactants such as nonionic, anionic, cationic and fluorine-based surfactants can be added to the coating solution for improving coating properties and antistatic properties.

Various well-known coating means such as a blade coater, a rod coater, a knife coater, a roll doctor coater, a reverse roll coater, a transfer roll coater, a gravure coater, a kiss coater, and a curtain coater can be used. The coating amount of each coating solution is, of course, adjusted to reach the predetermined dry weight of each layer.

Supports constituting these recording materials are not particularly limited and various supports which are used in general recording materials can be used. Examples of the support include resin films, such as a polyester film, a polyethylene terephthalate film, a polyethylene naphthalate film, a cellulose nitrate film, a cellulose ester film, a polyvinyl acetal film, and a polycarbonate film; various metals, such as aluminum, zinc and copper; glass and paper.

EXAMPLE

The present invention is described with reference to specific examples but the present invention is not limited thereto without departing from the spirit and scope thereof.

Preparation of Organic Silver Dispersion

Forty (40) g of behenic acid, 7.3 g of stearic acid, and 500 ml of water were stirred at 90° C. for 15 minutes, 187 ml of 1 N sodium hydroxide was added over 15 minutes, further 61 ml of 1 N aqueous solution of nitric acid was added thereto and the temperature was lowered to 50° C. Then, 124 ml of a 1 N aqueous solution of silver nitrate was added over 2 minutes and the reaction mixture was stirred for 30 minutes. Thereafter, the solid content was filtered with suction and the solid content filtered was washed with water until the conductance of the filtered water reached 30 μS/cm. The thus-obtained solid content was not dried and dealt with as a wet cake. Ten (10) g of polyvinyl alcohol (trade name: PVA-205) and water were added to the wet cake corresponding to 100 g of dry solid content to make the entire weight 500 g and pre-dispersed by a homomixer.

Subsequently, the pre-dispersed stock solution was treated three times using a disperser (trade name: "Microfluidizer M-110S-EH", manufactured by Microfluidex International Corporation, G10Z interaction chamber was used) with adjusting the pressure of the disperser to 1,750 kg/cm Thus, the preparation of organic silver fine particle dispersion having volume addition average diameter of 0.39 μm was terminated. Determination of the grain size was carried out using Master Sizer X manufactured by Malvern Instruments Ltd.

Preparation of Silver Halide Grains

Twenty-two (22) g of phthalated gelatin and 30 mg of potassium bromide were dissolved in 700 ml of water, pH was adjusted to 5.0 at 40° C., then 159 ml of an aqueous solution containing 18.6 g of silver nitrate and an aqueous solution containing potassium bromide were added thereto by a controlled double jet method over 10 minutes with maintaining the pAg at 7.7. Subsequently, 476 ml of an aqueous solution containing 55.4 g of silver nitrate and an aqueous solution containing 8 μmol/liter of dipotassium hexachloroiridate and 1 mol/liter of potassium bromide were added thereto by a controlled double jet method over 30 minutes with maintaining the pAg at 7.7. Thereafter, the pH value was lowered and desalt treatment was performed by flocculation sedimentation, then 0.1 g of phenoxy ethanol was added to adjust the pH and pAg to 5.9 and 8.0, respectively. The thus-obtained grains were cubic grains having the average grain size of 0.07 μm, the variation coefficient of the projected area diameter of 8%, and {100} face ratio of 86%.

The temperature of the above-prepared silver halide grains was increased to 60° C., and then 85 μmol of sodium thiosulfate, 11 μmol of 2,3,4,5,6-pentafluorophenyldiphenylphosphine selenide, 2 μmol of the following tellurium compound 1, 3.3 μmol of chloroauric acid, and 230 μmol of thiocyanic acid, each per mol of silver were added, and the reaction system was ripened for 120 minutes.

Subsequently, the temperature was lowered to 40° C., and $3.5\times10^{-4}$ mol of the following sensitizing dye A was added to the silver halide while stirring, after 5 minutes, $4.6\times10^{-3}$ mol of the following compound A was added to the silver halide, stirred for 5 minutes, then quenched to 25° C., thus silver halide grains were prepared.

Sensitizing Dye A

Sensitizing Dye A

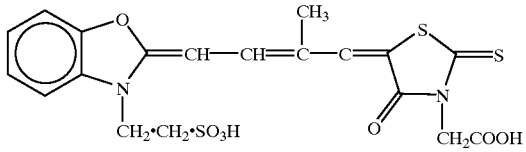

Compound A

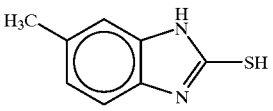

-continued

Tellurium Compound 1

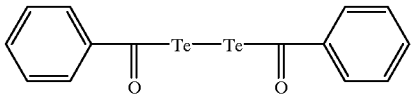

Preparation of Solid Fine Particle Dispersion Solution Stocks

Solid fine particle dispersions of tetrachlorophthalic acid, 1,1-bis(2-hydroxy-3,5-dimethylphenyl)-3,5,5-trimethylhexane and tribromomethylphenylsulfone were prepared respectively.

To tetrachlorophthalic acid were added 0.81 g of hydroxypropylmethyl cellulose and 94.2 ml of water and the mixture was thoroughly stirred to make slurry. The slurry was allowed to stand for 10 hours. Subsequently, 100 ml of zirconia beads having the average diameter of 0.5 mm and the above obtained slurry were put in a vessel and dispersed in a disperser (a ¼ G Sand Grinder Mill: manufactured by Imex K.K.) for 5 hours, thereby solid fine particle dispersion solution of tetrachlorophthalic acid was obtained. Seventy (70) wt % of the obtained grains had a particle diameter of 1.0 μm or less. With respect to other compounds, respective solid fine particle dispersion solutions were prepared by optionally changing the amount of the dispersant and dispersing time for obtaining the desired average particle diameter.

Preparation of Polymer Fine Particle Dispersion Containing Dye

A solution containing 2 g of the following dye A, 6 g of a methyl methacrylate/methacrylic acid copolymer (85/15), and 40 ml of ethyl acetate was heated to 60° C. and dissolved, and then this solution was added to 100 ml of an aqueous solution containing 5 g of polyvinyl alcohol and finely dispersed using a high rate stirrer (homogenizer, manufactured by Nippon Seiki Seisaku-sho Co., Ltd.) at 12,000 rpm for 5 minutes, thus, polymer fine particle emulsification dispersion P having the average particle diameter of 0.3 μm was obtained.

Dye A

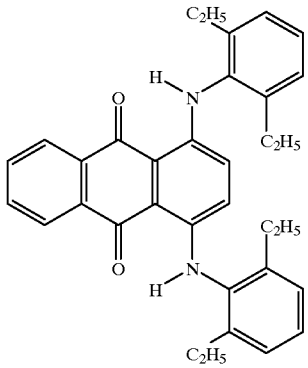

Preparation of Emulsion Layer Coating Solution

To the above-prepared organic silver fine particle dispersion (an amount corresponding to 1 mol of silver) were added silver halide grains in an amount of 10 mol % (as a silver halide coverage) based on organic silver in the organic silver fine particle dispersion and the following binder and materials for development, thereby emulsion coating solution was obtained.

Binder

LACSTAR 3307B (manufactured by Dainippon Chemicals and Ink Co., Ltd.; SBR latex): 430 g Materials for Development Tetrachlorophthalic acid: 5 g (contained in the above dispersion)

1,1-Bis(2-hydroxy-3,5-dimethylphenyl)-3,5,5-trimethylhexane: 98 g (contained in the above dispersion)

Phthalazine: 9.2 g

Tribromomethylphenylsulfone: 12 (contained in the above dispersion)

4-Methylphthalic acid: 7 g

Dye

Dye A: 4 g (contained in the above polymer fine particle dispersion containing dye)

LACSTAR 3307B used above was a polymer latex of a styrene/butadiene copolymer, and the average particle size of the dispersion was about 0.1 μm to about 0.15 μm.

Preparation of Coating Solution for Protective Layer of Emulsion Surface

Zero point two six (0.26) g of surfactant A, 0.09 g of surfactant B, 0.9 g of silica fine particles (average particle size: 2.5 μm), 0.3 g of 1,2-bis(vinylsulfonyl-acetamido) ethane, and 64 g of water were added to 10 g of inert gelatin to make the coating solution for the protective layer of the emulsion surface.

Surfactant A

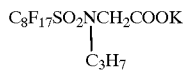

Surfactant B

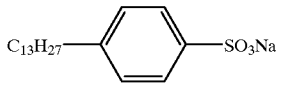

Preparation of Dye Dispersion

The following dye B in an amount of 0.8 g was added to 35 g of ethyl acetate, stirred and dissolved. To the solution was added 85 g of an aqueous solution containing 6 wt % of pre-dissolved polyvinyl alcohol (PVA-217) and the solution was stirred by a homogenizer for 5 minutes. Then, the ethyl acetate was volatilized by desolvation, diluted with water in the last place, thereby the dye dispersion was prepared.

Dye B

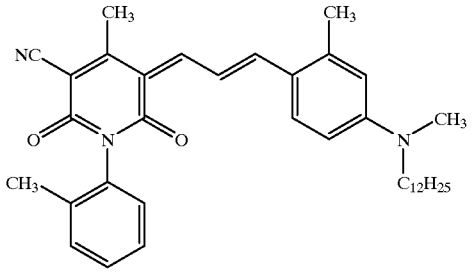

Preparation of Solid Base Fine Particle Dispersion

To 26 g of the following solid base, 234 g of an aqueous solution containing 2 g of polyvinyl alcohol (PVA- 215) was added and thoroughly stirred to make a slurry. The slurry was allowed to stand for 10 hours. Subsequently, 100 ml of zirconia beads having the average diameter of 0.5 mm and the above slurry were put in a vessel and dispersed in a disperser (a ¼ G Sand Grinder Mill: manufactured by Imex K.K.) for 5 hours, thereby a solution of solid base fine particle dispersion was obtained.

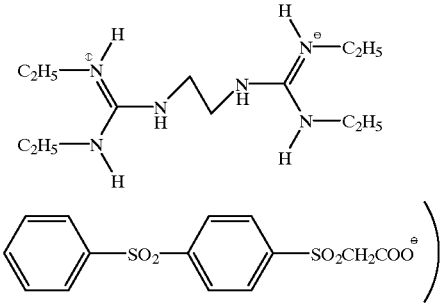

Preparation of Coating Solution for Back Surface

Coating solution for the back surface was prepared by adding 20 g of the above-prepared dye dispersion, 20 g of the above-prepared solid base fine particle dispersion and 35 g of water to 38 g of a 10% aqueous gelatin solution.

Preparation of Coating Solution for Protective Layer of Back Surface

Zero point two six (0.26) g of surfactant A, 0.09 g of surfactant B, 0.3 g of 1,2-bis(vinylsulfonylacetamido)-ethane, 0.4 g of Sildex H121 (really spherical silica, manufactured by Dokai Chemical Co., Ltd., average particle size: 12 μm) and 64 g of water were added to 10 g of inert gelatin to make the coating solution for the protective layer of the back surface.

Preparation of Coated Sample

The above-prepared coating solution for the emulsion layer was coated on a polyethylene terephthalate support having the thickness of 175 μm by adjusting the additives in the light-sensitive layer so as to give a silver coverage of 2.2 g/m$^2$, and then the coating solution for the protective layer of the emulsion surface was coated on the emulsion coated layer so as to give a gelatin coverage of 1.8 g/m$^2$. After drying, the coating solution for the back surface was coated on the side opposite to the side on which the emulsion layer was coated so as to give dye B coverage of 56 mg/M$^2$. Further, the coating solution for the protective layer of the back surface was coated on the back surface coated layer so as to give a gelatin coverage of 1.8 g/m$^2$. Thus, the sample was prepared.

Image formation was conducted on the above-mentioned recording material using the heat developing apparatus 10 shown in FIG. 1. The size of the recording material was a half cut size (i.e., 356×430 mm), and the distance H between the peeling part 72 and the transferring roller pairs 140 was set to 200 mm, adjusting the distance to the size. The temperature of the heating drum 68 was controlled to 120° C.±1° C. Further, the peeling angle (θ) of the peeling part 72 was 90°, and the transferring speed was 20 mm/second. Thus, the temperature of the recording material reached 85° C. when it came into contact with the transfer roller pairs 140.

The resulting image had no uneven development and was high in image quality.

As described above, according to the heat developing method and apparatus of the present invention, the heat-developable light-sensitive material or light-sensitive heat-sensitive recording material peeled from the heating means does not come into contact with other members until the temperature thereof is lowered to a development proceeding temperature or less. Accordingly, uneven development caused by contact does not occur, and uniform images having no defects are obtained.

While the invention has been described in detail and with reference to specific embodiments thereof, it will be apparent to one skilled in the art that various changes and modifications can be made therein without departing from the spirit and scope thereof.

What is claimed is:

1. A heat developing method for obtaining a visible image comprising contacting a heat-developable light-sensitive material or a light-sensitive heat-sensitive recording material on which a latent image has been formed with a heating means in a heat developing part, wherein said heat-developable light-sensitive material or light-sensitive heat-sensitive recording material which is peeled off from said heating means is cooled, in a noncontacting state, to a temperature not higher than a temperature at which progress of development is stopped, and then, said material is held with a transfer means for discharging said material outside of the heat developing art.

* * * * *